US006532884B2

(12) United States Patent
Profitt et al.

(10) Patent No.: US 6,532,884 B2
(45) Date of Patent: Mar. 18, 2003

(54) HIGH SPEED ELECTRIC WATERCRAFT

(75) Inventors: James Arthur Profitt, Goshen, IN (US); Joseph Timothy Peek, Homosassa Springs, FL (US); Kayo Motsenbocker, Fredericksburg, VA (US); Marvin Andrew Motsenbocker, Fredericksburg, VA (US)

(73) Assignee: Maruta Electric Boatworks LLC, Fredericksburg, VA (US)

( * ) Notice: Subject to any disclaimer, the term of this patent is extended or adjusted under 35 U.S.C. 154(b) by 0 days.

(21) Appl. No.: 09/877,196

(22) Filed: Jun. 11, 2001

(65) Prior Publication Data

US 2002/0023579 A1 Feb. 28, 2002

Related U.S. Application Data

(63) Continuation-in-part of application No. 09/561,972, filed on May 1, 2000, now Pat. No. 6,273,015.
(60) Provisional application No. 60/254,786, filed on Dec. 13, 2000.

(51) Int. Cl.[7] ..... B63B 1/00
(52) U.S. Cl. ..... 114/61.12; 114/283; 440/6
(58) Field of Search ..... 114/61.1, 61.12, 114/61.13, 61.14, 61.2, 61.26, 121, 271, 274, 283, 292; 440/3, 4, 6, 8

(56) References Cited

U.S. PATENT DOCUMENTS

| | | | | |
|---|---|---|---|---|
| 3,517,632 | A | 6/1970 | Gray | |
| 3,653,349 | A | 4/1972 | Brown | |
| 3,842,772 | A | 10/1974 | Lang | |
| 4,174,671 | A | 11/1979 | Seidl | |
| 4,261,277 | A | 4/1981 | Bergman | 114/125 |
| 4,345,533 | A | 8/1982 | Kunitake | |
| 4,557,211 | A | 12/1985 | Schmidt | |

(List continued on next page.)

FOREIGN PATENT DOCUMENTS

| | | | |
|---|---|---|---|
| CH | 637684 | 8/1983 | 440/6 |
| GB | 2297728 | 8/1996 | |

OTHER PUBLICATIONS

Hydrolance Corp Website, "Coastal Patrol & Rescue Craft #HL–5 (2000)" "Recreational Sports Yacht" (2000).
Popular Mechanics Mar. 1996 Tech Update, "Hybrid—Hulled Attack Frigate Levels the Waves" (from *http://popularmechanics.com/popmech/sci/tech/9603TUTRLM-.html*).
Professional. Boat Builder Oct./Nov. 1997, "HYSWAS: A Waterborne Unicycle" Dick Akers p. 45.

*Primary Examiner*—Stephen Avila
(74) *Attorney, Agent, or Firm*—Marcin Motsenbocker

(57) ABSTRACT

High speed electric watercraft of various configurations are provided that utilize at least one submerged enclosed hull containing an electric motor and at least one other parallel float positioned higher that the enclosed hull to provide buoyancy for a platform that can carry one or more individuals above a water surface. The watercraft optionally include features of (1) a rounded front end on the platform, (2) a platform length that is shorter than the float for stability against tipping, (3) entryways that do not require stepping over a vessel hull, (4) dimensions fore and aft that minimize spray onto the rear of the platform, (5) shock absorbers to provide a smoother ride, and (6) adjustable struts that connect floats with the platform to allow control of the platform height above the water surface. These and other features are made possible by a fast electric design that avoids certain problems of vessel type watercraft.

20 Claims, 15 Drawing Sheets

U.S. PATENT DOCUMENTS

| | | | | | |
|---|---|---|---|---|---|
| 4,730,571 | A | * | 3/1988 | Hedlund et al. | 114/61.24 |
| 4,763,596 | A | | 8/1988 | Yoshida | |
| 4,986,204 | A | | 1/1991 | Yoshida | |
| 5,174,233 | A | | 12/1992 | Nielsen | 114/123 |
| 5,178,085 | A | | 1/1993 | Hsu | 114/283 |
| 5,329,870 | A | | 7/1994 | Cook | 114/280 |
| 5,465,679 | A | | 11/1995 | Mardikian | 114/363 |
| 5,511,504 | A | | 4/1996 | Martin | |
| 5,522,333 | A | | 6/1996 | Lang et al. | |
| 5,540,169 | A | | 7/1996 | Davis et al. | |
| 5,544,607 | A | | 8/1996 | Rorabaugh et al. | |
| 5,694,878 | A | | 12/1997 | Masuyama | |
| 5,915,328 | A | * | 6/1999 | Rowan | 114/362 |
| 5,941,189 | A | | 8/1999 | Johansson | |
| 6,152,062 | A | | 11/2000 | Hatturi | 114/343 |
| 6,176,190 | B1 | | 1/2001 | Ozga | 114/61.15 |
| 6,182,590 | B1 | | 2/2001 | Patera | 114/363 |
| 6,182,596 | B1 | | 2/2001 | Johnson | 114/284 |
| 6,182,598 | B1 | | 2/2001 | Bozzo | 114/362 |

* cited by examiner

HIGH SPEED ELECTRIC WATERCRAFT

This application is a continuation in part application of Ser. No. 09/561,972, now U.S. Pat. No. 6,273,015, and enjoys priority from U.S. Provisional No. 60/254,786, filed Dec. 13, 2000 both of which are incorporated by reference in their entireties.

FIELD OF THE INVENTION

The invention relates to electric motor driven watercraft and particularly to hull configurations made possible by application of hidden log technology to watercraft.

BACKGROUND OF THE INVENTION

Private consumer watercraft used for fishing, cruising, waterskiing and the like typically are less than 30 feet long, most often less than 24 feet long, and can be pulled on a trailer behind a car for inexpensive boating. Such a watercraft generally has a displacement hull and is powered by an air-breathing fossil fueled motor connected to a fuel tank that holds a hydrocarbon high energy density power source. The hull displaces water when at rest and generally must be raised above the water surface to achieve high speed operation. Energy for this purpose is created from noisy explosions from within a high horsepower motor located at one end of the vessel hull, if the boat is a traditional outboard design, or perhaps from an engine within a hull that drives an impeller, as used in modem jet skis designs. Such pleasurecraft achieve high speed by virtue of advances in hull design and in high output fossil fueled motors.

The basic hull design of a fast pleasureboat having one or two attached motors has undergone little modification over the years. Many performance advances arose from simply increasing motor(s) size. In fact, early in the last century internal combustion engine powered watercraft became dominant and displaced electric powered watercraft because of their higher output to weight ratio (including the power source). That is, large horsepower engines became available to supply massive amounts of energy needed to lift up the weight of the boat (including the low weight hydrocarbon fuel supply), allowing high speed but low efficiency hydroplaning operation. Electric boats in contrast, have smaller motors with heavy batteries and generally are unable to match the speed and duration performance of the internal combustion powered pleasurecraft.

Other advances in the pleasureboat art arose from changes in hull configuration for increased operator convenience and/or speed. A representative improvement in this regard is described in U.S. Pat. No. 6,116,182. As summarized in that patent the floor of a boat hull may be altered for carrying passener(s) with a "raised after section that rises above the level of the deck platform . . . " and using "a downwardly sloped surface" to facilitate rider comfort and related changes to a hull that remains at the surface of the water when not moving. Boat hull improvements over the years have included among other things, easier entry and exit into the boat, streamlining the bathtub-like wall of the boat, and increasing watercraft stability by adding floatation.

Unfortunately for those interested in advantages of quiet electric propulsion, most developments relate to high power output internal combustion engine powered watercraft. Electric powered practical planing boats appear out of reach for the pleasure boat market. In fact, electric powered pleasurecraft less than 30 feet long designed for cruising are thought to be restricted to hull displacement speeds of less than 10 miles per hour. As we have described in an earlier filed application, multi-hulled ships such as pontoon boats and catamarans, and SWATH type craft, offer alternative designs, but have serious drawbacks, particularly in the context of smaller pleasurecraft that are driven by electric motors.

During their experimentation and design activities in challenging the low speed paradigm for electric boating the inventors made several discoveries that provide advantages to electric motor driven pleasurecraft with heavy power supplies. These advantages include, among others, increased speed, efficiency, stability, and operator convenience, as described below.

SUMMARY OF THE INVENTION

One embodiment of the invention is an electric motor driven watercraft comprising an upper platform with walls connected beneath to one or two submerged support members and one or two floating skis wherein the walls have egress openings on their starboard and port sides for easy boarding without stepping over a wall, the one or two support members provide buoyancy yet are completely submerged and positioned lateral to the floating skis and each contains an electric motor, and wherein the skis contain floatation that provides buoyancy to maintain watercraft stability during rest.

Another embodiment is an electric motor driven watercraft comprising an upper platform held above the water surface by a distance D and connected beneath to one submerged support member having an electric motor and to two floating skis, wherein the support member is located below, parallel and between the skis, and wherein the skis protrude forward of the platform by distance D and protrude rearward of the platform by distance D.

Another embodiment is an electric motor driven watercraft comprising an upper floating platform connected beneath to two elongated support members, one on each side of and below the platform, wherein each support member comprises an electric motor and propeller and provides buoyancy or lifting force to lift the platform during forward motion, and wherein the platform floats on the water surface during rest but is propelled forward by action of the electric motors.

Another embodiment is a wave dampening watercraft comprising a platform, a submerged support member attached underneath thereto having at least 25 percent of the empty watercraft mass, and two skis attached beneath the platform wherein the linkage between the platform and the skis comprises a shock absorber that absorbs wave energy colliding with the skis. In a preferred embodiment the shock absorber regenerates electrical energy to recharge batteries used to drive the watercraft.

Another embodiment of the invention is an electric motor driven watercraft less than 30 feet long comprising an upper platform held above the water and connected beneath to at least one ski and to at least one support member, wherein each support member comprises a power source and electric motor and provides positive buoyancy to hold up the platform, and wherein each skis has floatation that helps hold up the watercraft above the water surface during rest and is positioned above the support member but below the platform and provides stability against pitch and roll tendencies during forward motion and wherein the power source and electric motor combined account for at least 10 percent of the watercraft mass.

Another embodiment of the invention is an electric motor driven watercraft comprising a platform held up from the water surface through a distance D by buoyancy from a submerged support member located underneath the platform and by two floating skis located parallel to and on either side of the platform, wherein the floating skis are buoyant, are positioned underneath the platform by distance D but above the submerged support member, provide lateral stability to the platform during rest and wherein each floating skis extends both in front of and to the rear of the length of the platform surface that is accessible to passengers by a distance of at least D.

Yet another embodiment of the invention is an automated electronic steering device for watercraft comprising a plurality of terrestrial magnetic field sensors, wherein at least two sensors detect progressive deviation from a desired course, the progressive deviation sensors provide power adjustment signals to at least one electric motor that affects the watercraft direction of travel, and wherein the magnetic field sensors are mechanically held in a fixed position in a platen that is rotated to select a desired direction.

DETAILED DESCRIPTION OF THE INVENTION

The present invention was prompted by studies with an alternative electric boat design using the hidden log or "kakusu maruta" approach that is described in priority documents U.S. Application Ser. Nos. 60/076,002; 09/252,038 (Now U.S. Pat. No. 6,073,569 and U.S. application entitled Stabilized Electric Boat Designs for High Speed Cruising, Diving and Sailing filed May 1, 2000, the contents of which are specifically incorporated by reference in their entireties. During their investigations through construction of practical working examples and through design activities, the inventors have discovered hull shapes and conformations made possible by the kakusu maruta method and which provide enhanced watercraft performance. These embodiments of improved electric watercraft are described below under "General Teaching" and more specifically in items A through H.

General Teaching

As first described in U.S. patent application Ser. Nos. 60/076,002 and 09/252,038 a "fast" electric watercraft according to the invention comprises three parts: 1) a platform, which acts as a compartment, or carrier for holding occupants, (2) one or more skis for planing over the water, and 3) one or more submerged support units that contain propulsion unit(s) wherein the support unit(s) have a buoyancy that holds up the platform via struts (typically fin-like) that pierce the water surface. The term "fast" as used herein, means that the watercraft travels at a speed above the calculated hull speed of a displacement watercraft of the same length. In preferred embodiments a heavy power source is present in the support unit(s), and the support unit(s) provide at least some and preferably most of the upward force necessary to hold the platform above the water surface. In a preferred embodiment one central support member is used having a low energy density power source and motor, wherein the motor and power source comprise at least 25 percent, preferably at least 40 percent and more preferably more than 60 percent of the total watercraft mass.

Figure 1:
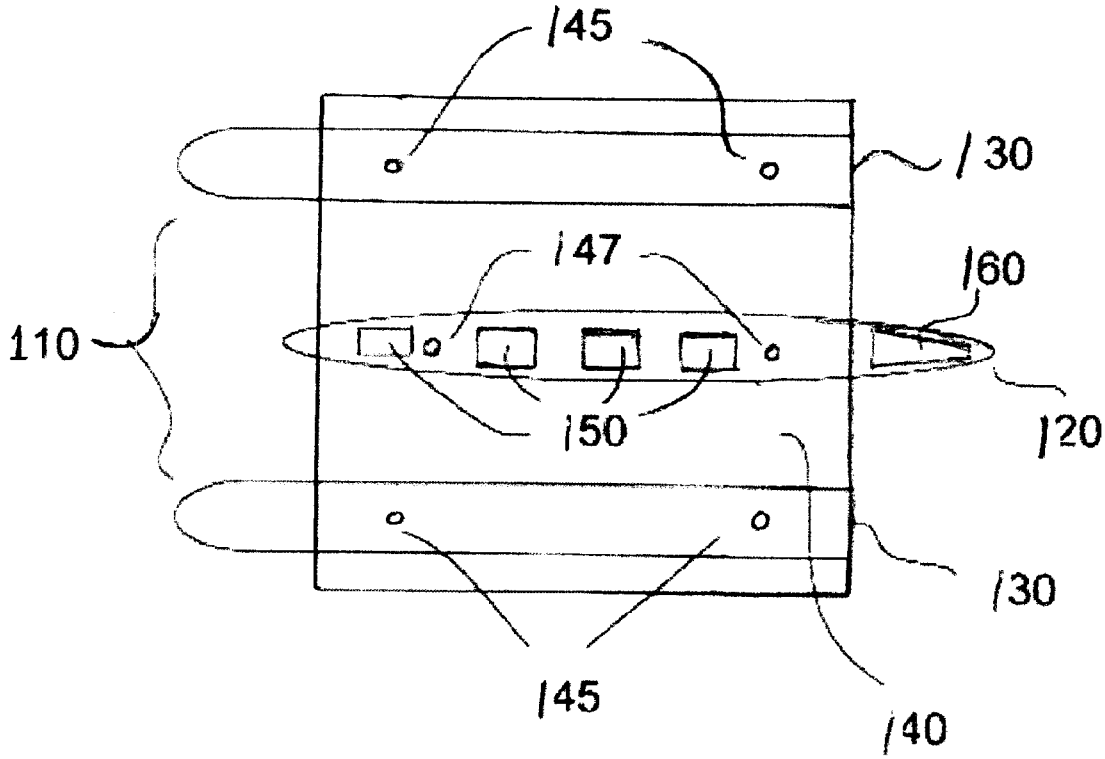
FIG. 1 shows a representative layout of a watercraft according to the invention.

FIG. 1 shows an advantageous embodiment of a watercraft 110 having one support member 120 that contains low energy density power supply 150 and motor 160, two floating skis 130 and platform 140. Platform 140 is held above the water by the support member and skis by surface piercing strut(s) 145 and 147 that preferably are in a fin shape. Equivalently, the "struts" connecting the platform to each support member or floating skis may be a single elongated unit at the top of each support member (or floating skis), or could assume the form of several fins, hyudrodynamic poles and the like.

The platform can be a variety of shapes and sizes and preferably includes at least one seat. The ski(s) in most embodiments contain floatation material such as polyurethane and provides stability during rest. In one embodiment the platform acts as a skis during rest and gradually arises above the water surface as the watercraft reaches cruising speed. In other embodiments the platform does not float in the water at rest, but is supported above the water at all times by one or more support members and/or floating skis. In preferred embodiments, a low energy density power source/supply (i.e. having less than one fourth of the available power per unit weight compared to gasoline and more typically less than one tenth that of gasoline, assuming use of the power source in equal efficiency motors) is present in the support unit(s). In advantageous embodiments, the low energy density power supply and electric motor, including any conversion equipment such as a fuel cell, has a mass that exceeds 10%, more preferably 25% and even more preferably 50% of the total empty watercraft weight. In the future, chemical conversion systems (such as a small turbine) are expected to be invented that equivalently perform the same function the same way in the context of the invention and yield the same results as those contemplated with present lead-acid battery and electric motor technology. For these embodiments the machine for converting chemical energy to electric power is included in the definition of power supply.

By placing one or more massive power source(s) in one or more support members below the water surface several advantages are realized. One advantage is that the mass stabilizes the watercraft and allows the watercraft to carry a larger amount of the power source while permitting higher speed operation compared with regular displacement hull electric boats that are limited by "hull speed." Another advantage is the ability to use a large variety of platform styles that may differ from a bathtub shape as exemplified in the figures presented here. Yet another advantage is that the submerged mass can be coordinated with optional floating skis to improve lateral stability. Still further, shock absorbers may be added to the skis, or linkage of skis to the platform to absorb wave collision energy and provide a smoother ride in rough water. Further advantages will be appreciated from a review of this specification.

While at rest, or at less than planing speed, the vehicle may require one or more floats to maintain stability against pitch and roll tendencies. In an embodiment shown in FIG. 2 the platform may supply most or all of the buoyancy but in most embodiments the support member(s) supply floatation force. At rest or at low speeds, additional floatation may be provided by the carrier for the occupants, or it may be provided by separate floats. For example, the skis may include floatation and thus are herein termed "skis-floats." While traveling at cruising speed (cruising speed means planing speed in the instance where a planing surface such as a skis is used) the occupant carrier is completely out of the water and the propulsion unit preferably is completely below the surface. The ski(s) normally maintain this condition, riding at the surface of the water.

In most embodiments shown here, separate ski-floats hold the platform off the water at all times but in some embodiments the platform itself is a float that sits on the water when not in motion. In every case the low energy density power supply is placed primarily below the surface in one or more enclosed hulls (support members). Although some fuel cell power sources to be developed in the future will have higher energy densities than present day batteries (as determined by factoring in their fuel supply and electrical conversion equipment together), such sources are considered equivalent in the context of the present invention. In many instances it will be very desirable to place a fuel cell within an enclosed hull below the surface for safety purposes and the invention specifically intends to provide this advantage to developers, manufacturers and marketers of fuel cells for watercraft propulsion. Furthermore, the fuel cell mass (herein defined to include both.fuel supply and chemical to electrical conversion equipment) can help stabilize a watercraft in a similar manner to that exemplified here for batteries. Thus, fuel cells are equivalent to batteries for the purpose of this invention.

Various Ski Conformations are Possible

Figure 2:
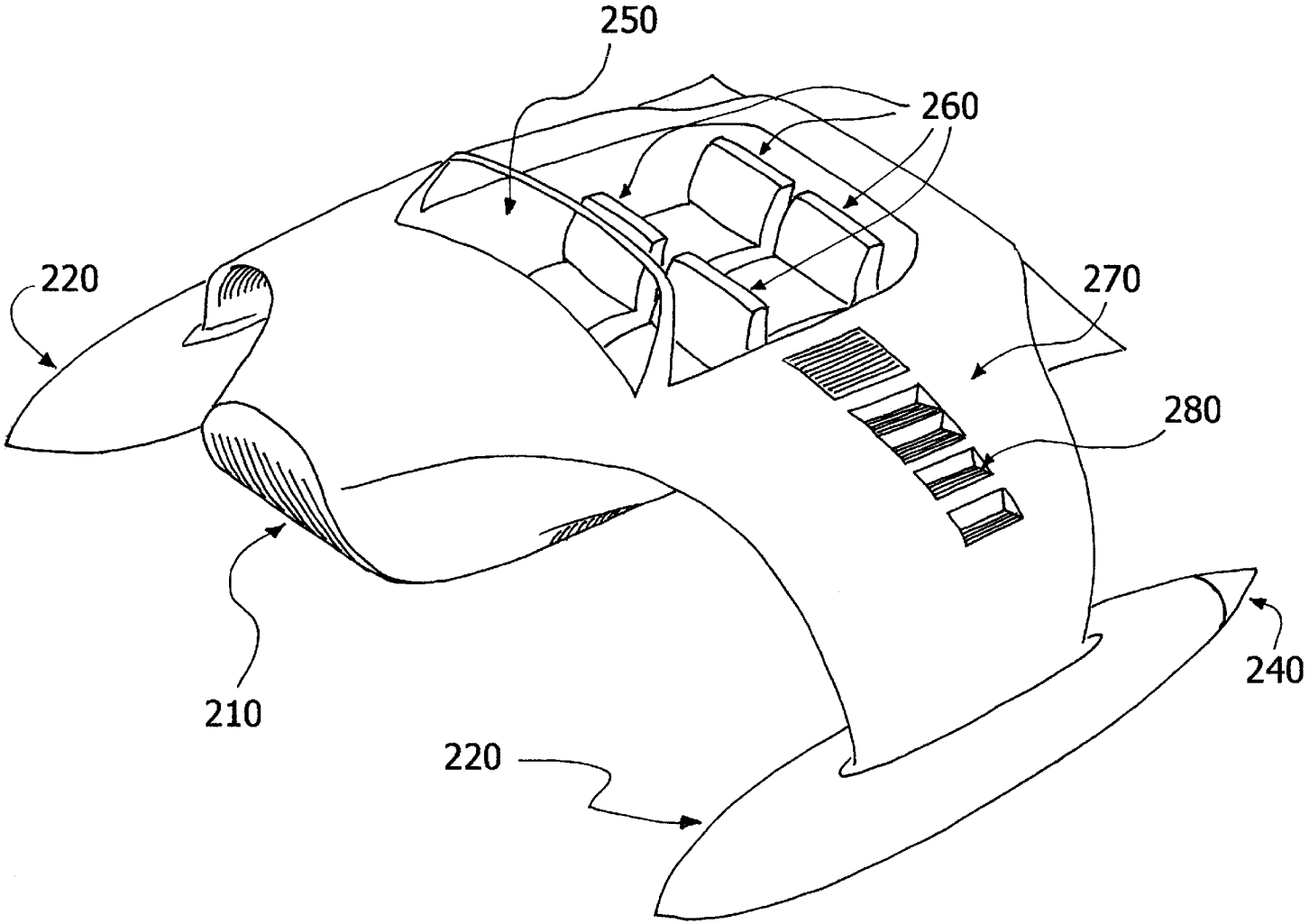
FIG. 2 shows a perspective view of a two propulsion unit watercraft having a single floating hull according to the invention.
Figure 7:
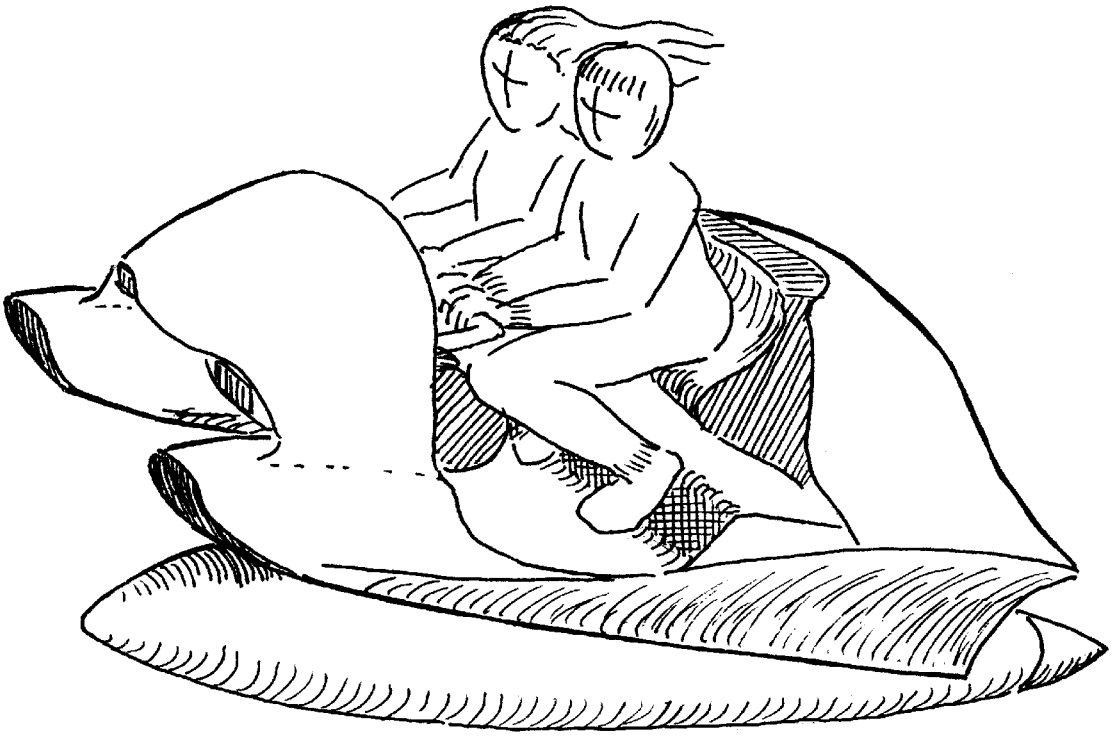
FIG. 7 shows a two seater (side by side) watercraft containing two skis, a central submerged support member, a rounded windshield and a rear hybrid power unit electric charging fossil-fueled power unit.

A watercraft according to the invention may comprise one ski, which doubles as a platform bottom or as a single outrigger parallel to a buoyant support member as shown in FIG. 7 of U.S. Pat. No. 6,073,569. An example of single ski design is shown in FIG. 2. That design has single floating platform 210 that holds passengers, two support members 220, which contain propulsion units 240, a windshield 250, seatbacks 260 and egress platform 270 with optional steps and friction surfaces 280.

The watercraft shown in FIG. 2 floats on platform 210 (also a ski) when at rest. Preferably platform 210 comes out of the water during forward motion. In one such embodiment upward force arises from buoyancy by adding air (or removing water ballast) to support members 220. In another embodiment upward force is provided by activation of the propulsion units 240, which can be positioned to force the watercraft up as well as forward (propellers and optional fins are not shown). In the latter case, stability against undesirable pitching may be had in an inexpensive manner by balancing the watercraft fore/aft and/or by arranging a horizonal fin control so that when the nose of a support member breaks the water surface, the watercraft will tend to pitch down due to decreased buoyancy fore of center. In another embodient such control is provided by an oblique surface at the rear of the watercraft, which contacts the water surface upon excessive pitching up of the watercraft. Other control mechanisms may be readily determined by a skilled artisan, such as movable fins on support members 220.

In another embodiment the platform 210 does not come out of the water during forward motion but planes on top of the water. In this embodiment a narrow portion of the centerline (fore to aft) of the platform bottom preferably protrudes and is flat or stepped as needed to minimize resistance during high speed operation, so that the watercraft skis on the centerline at high speed.

This embodiment of the invention differs from the high cost HYSWAS design being studied by the Navy in several ways. Most importantly, the inventive watercraft is inherently much more stable and vastly cheaper because it does not require the very expensive active control systems used in the high cost military projects. For example, the single float/platform configuration described herein having two lateral support units that contain power units inherently has more lateral stability while planing compared with the military's design. This is because flotation and/or lift are provided at both sides of the watercraft (from laterally positioned support members or skis), and does not arise from active control surfaces located below the center of the platform.

In one such configuration the support units are partly above the waterline when not moving, and become completely submerged only when cruising. That is, rather than rely on computer controlled fins etc., passive buoyancy stabilizes the watercraft at lateral positions, even at high speed while planing. In one embodiment the support units naturally float to the surface by their buoyancy when unpowered as a safety measure and to improve inherent stability. In a similar configuration the support units only become completely submerged during movement by negative lift along one or more control surfaces. In both instances, the support units provide auto-correcting stabilizing forces by virtue of their design, and do not require expensive computer controlled fin structures to constantly monitor and modily tilt in various axes during cruising.

Figure 3:
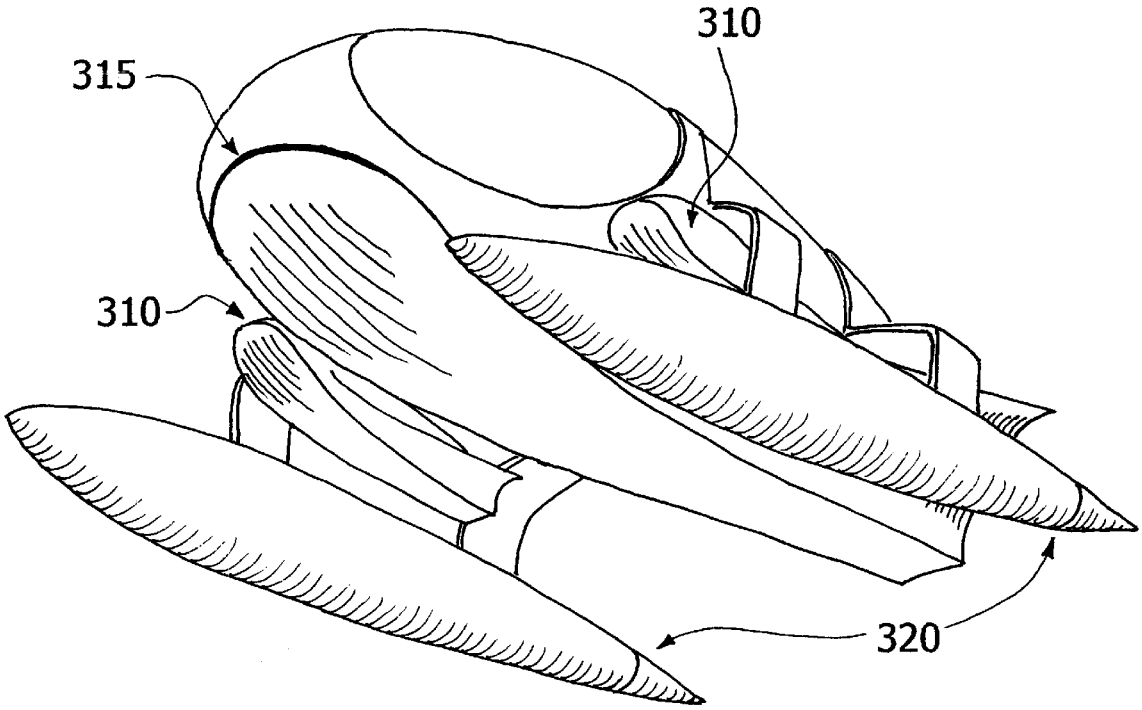
FIG. 3 shows a design having a single floating platform and two skis-floats for increased stability, according to an embodiment of the invention.

A watercraft may comprise two skis. For example, a single platform/ski design as shown in FIG. 2 may be combined with additional skis 310 as shown in FIG. 3 for lateral stability during motion. In the embodiment of FIG. 3, support members 320 provide some buoyancy. This watercraft relies more on additional skis 310 and less on controlling support members 320 or other control surfaces for stability and may be less complicated to manufacture and use. In this embodiment two lateral skis 310 serve as stabilizers against roll tendency and preferably have minimal width to minimize drag as shown in FIG. 3.

Figure 4:
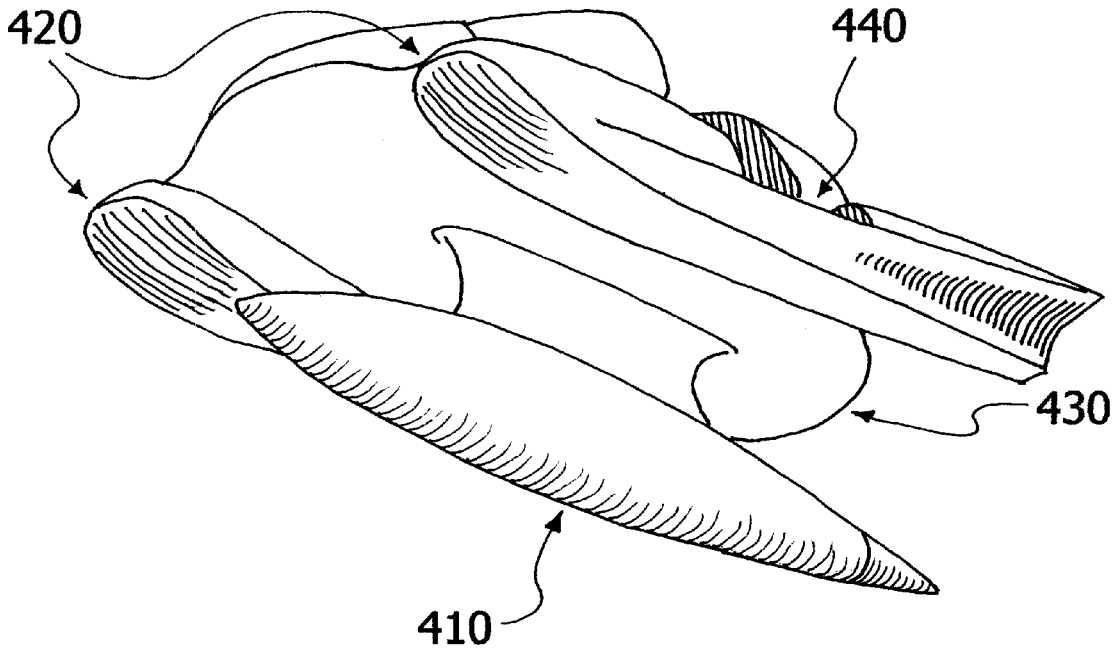
FIG. 4 shows a design having a central support unit and two lateral ski-floats according to an embodiment of the invention.

Of course, designs with two skis offer more roll stability. Such skis preferably exist as floats with smooth bottoms that can hydroplane when moving ("floating skis") for stability during boarding or at rest, as shown in FIG. 3 and in FIG. 4. FIG. 4 shows central support member 410 (propeller not shown) with parallel, laterally arranged floating skis 420 that assist in holding up platform 430 having a hybrid engine compartment 440 (gasoline motor to provide power to the motor and to recharge batteries in support member 410).

Figure 5:
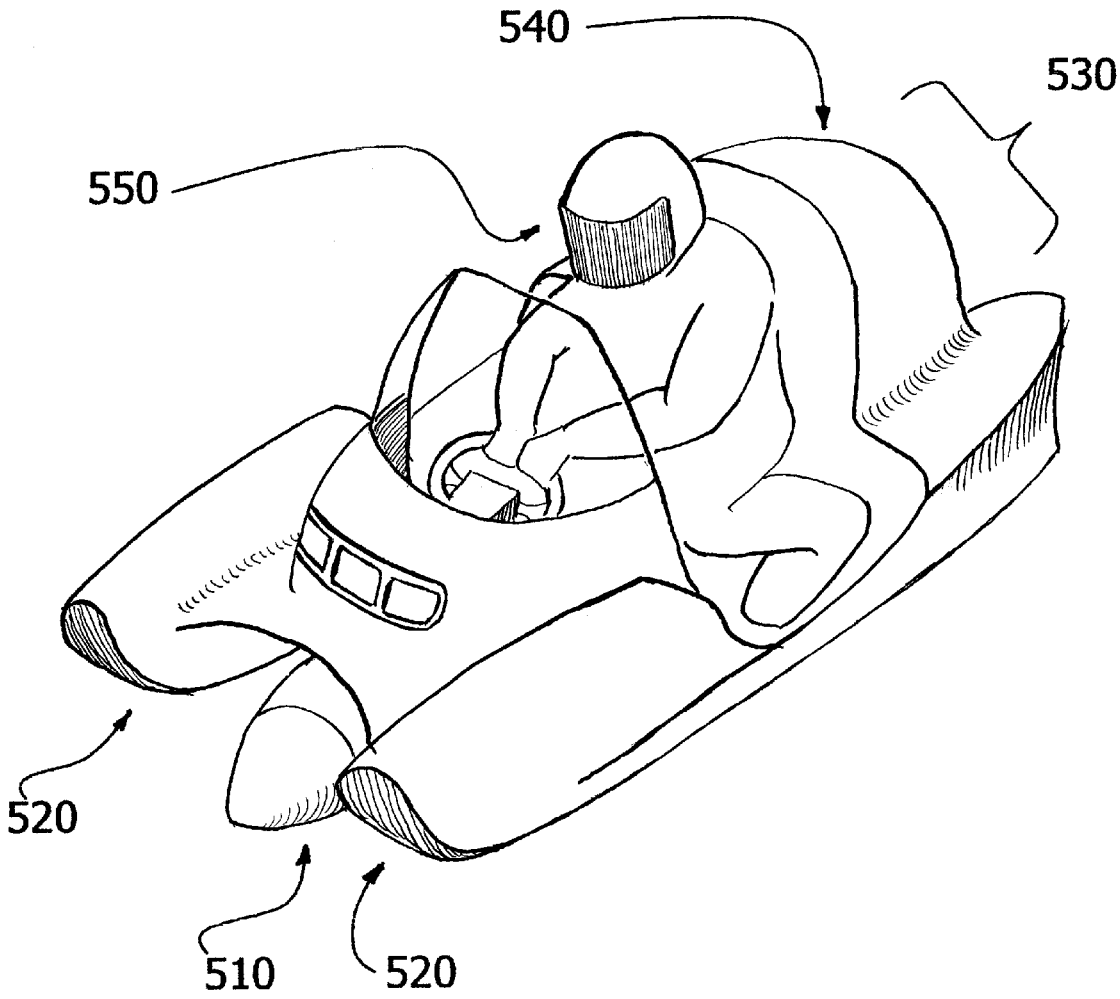
FIG. 5 shows a single seater personal watercraft according to the invention containing two skis, a central submerged support member, a rounded windshield and a rear hybrid power unit electric charging fossil-fueled power unit.

A top/side perspective of the watercraft from FIG. 4 is shown in FIG. 5. A single occupant 550 is depicted in this figure. Central support member 510 is centrally located and kept submerged and at least some buoyancy is provided by floating skis 520. Most preferably a small gasoline electric generator is present in compartment 540 to the rear of platform 530.

Alternative Designs that Use Two Lateral Floating Skis

Figure 6:
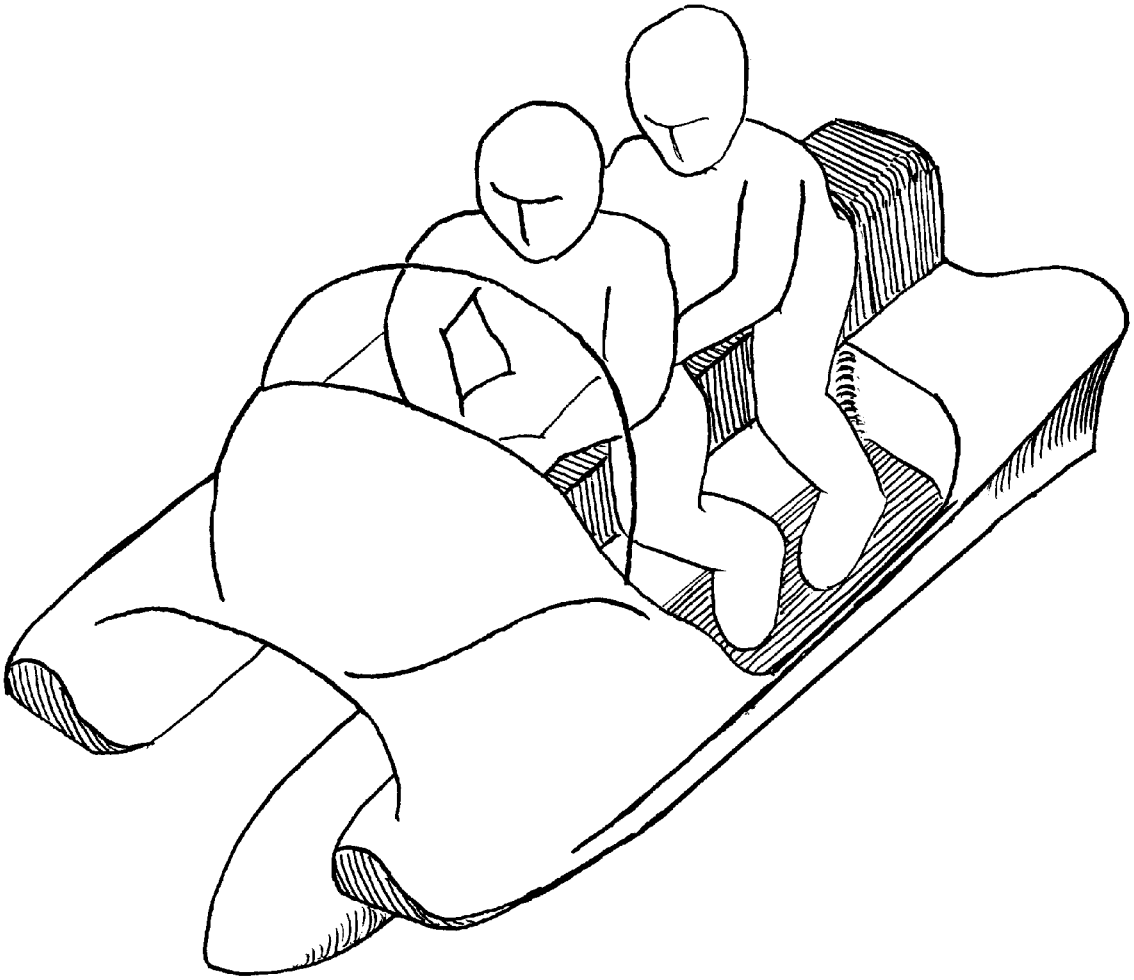
FIG. 6 shows a two seater (front and rear) watercraft containing two skis, a central submerged support member and a rounded windshield.
Figure 8:
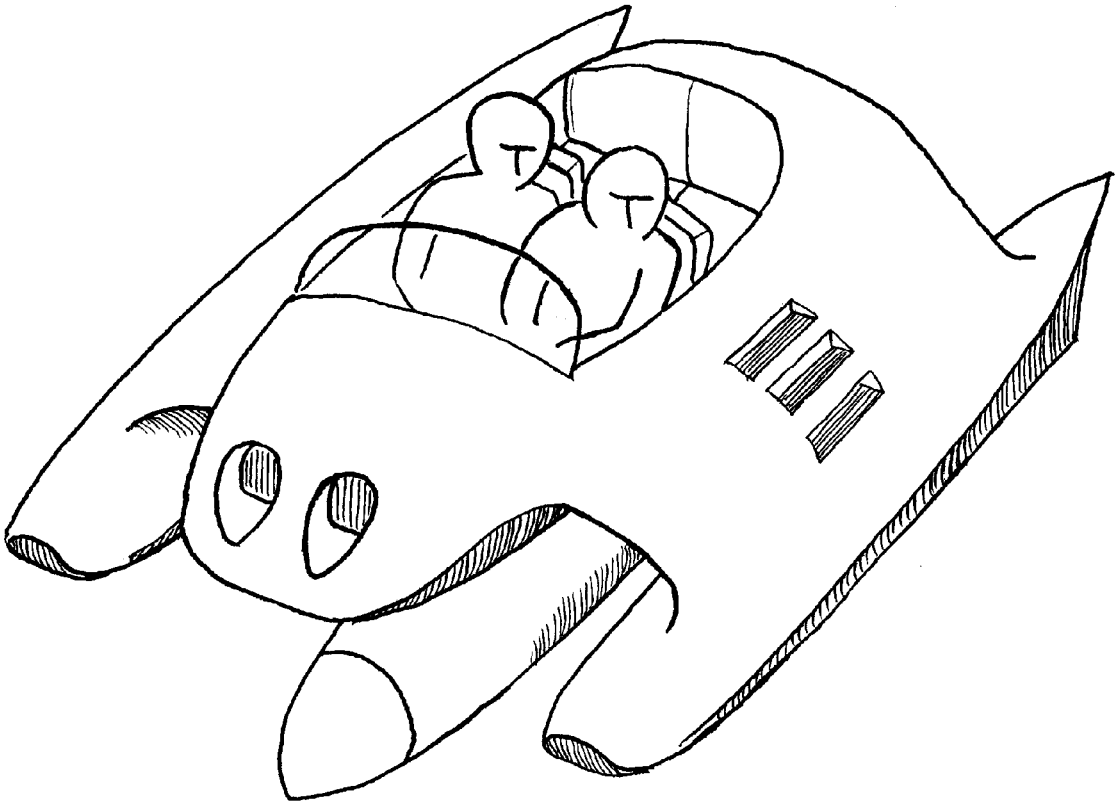
FIG. 8 shows a two seater (side by side) watercraft having two lateral floating skis, one central submerged support member, side entry decks with three steps and a platform with recessed seating.
Figure 9:
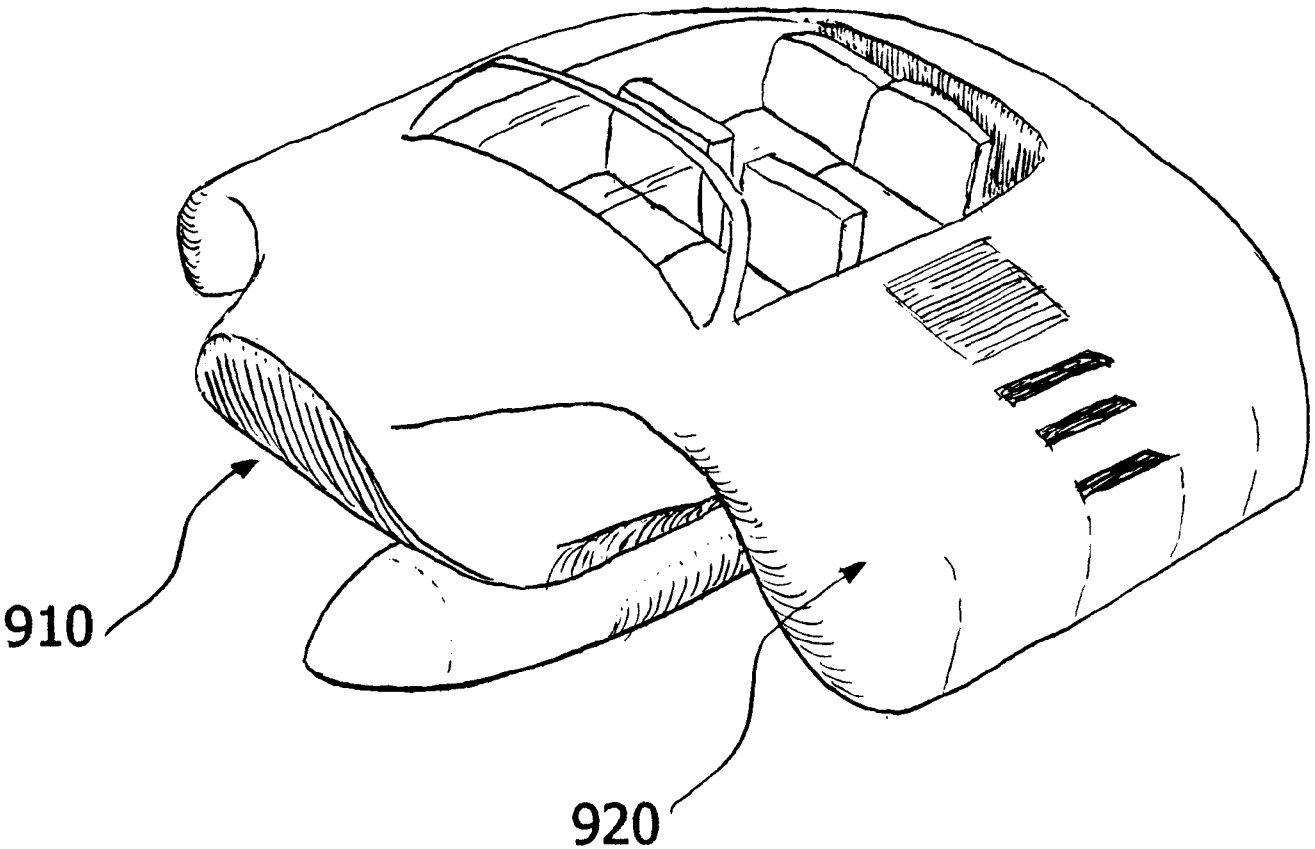
FIG. 9 shows a four seater watercraft having a floating platform, two lateral floating skis and and a central submerged support member.

Watercraft according to the invention may assume a variety of forms and sizes according to the principles enumerated herein. For example, the single support member watercraft having two lateral floating skis may accommodate different numbers of passengers seated side by side or front to back as depicted in FIGS. 6, 7 and 8. FIG. 9 shows, for example, a single float/platform that contains egress platforms that act as floats and only contact the water to provide buoyancy when not planing on the single float/platform.

Figure 10:
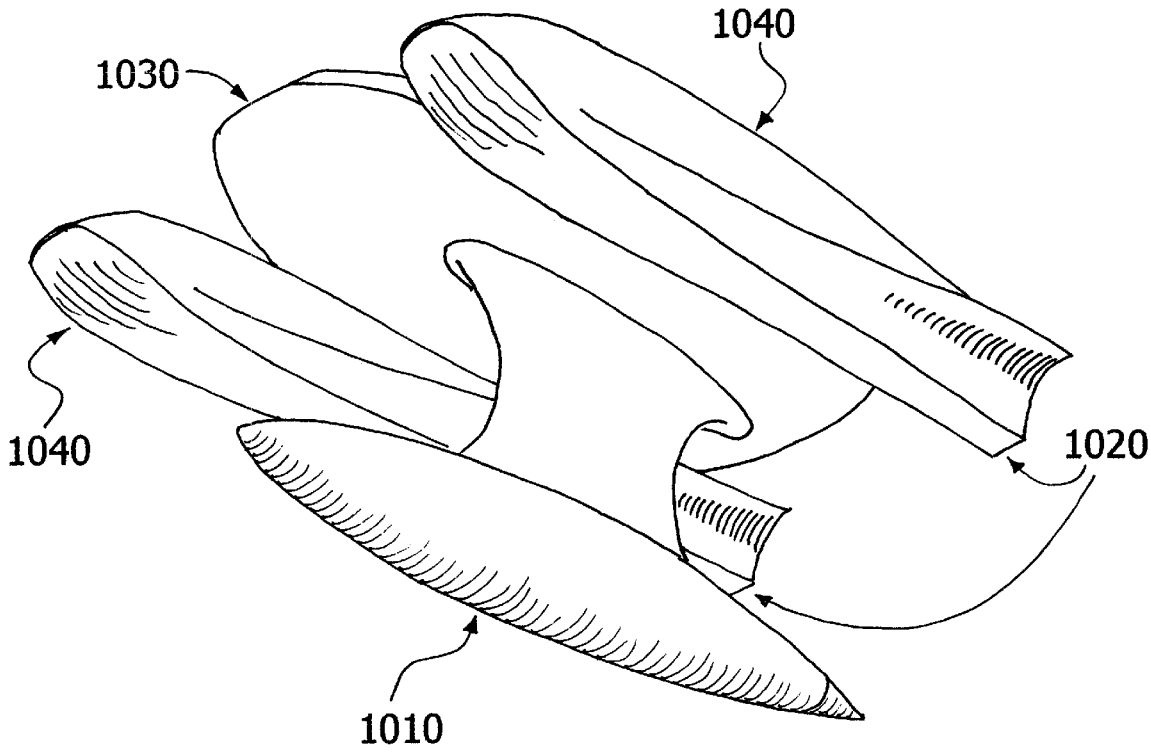
FIG. 10 shows a watercraft having two lateral floating skis and one central submerged support member that is submerged by more than the maximum diameter of the support member.

In each embodiment, the support member(s) preferably remain immersed during normal operation. Depending on the need for stability and the expected water depth, the support member(s) may be positioned deeper below the platform, as exemplified in FIG. 10. Support member 1010 is held at least one diameter below the water surface as nominally defined by the bottoms of lateral floating skis 1020. Such deeper positioning decreases the turbulance effect of support member 1010 in moving through the water. Platform 1030 holds occupants and can assume a variety of shapes according to a desired purpose of the boat builder. Preferably platform 1030 avoids contact with water while at cruising speed yet has low wind resistance for forward travel. Stabilizing skis 1020 serve to alleviate roll during motion and support unit 1010 preferably is controllably ballasted to provide upward force to hold platform 1030 out of the water as desired. A propeller preferably is provided at the aft position of support member 1010 but also/or instead may be provided at the aft positions of floating skis 1020.

Propulsion Unit Options

In many embodiments the propulsion unit is an electric motor with attached propeller that is powered by an electric storage battery. In an embodiment that will be favored in the future as costs and reliability improve, a fuel cell may be used to provide electrical energy to one or more electric motors.

The propulsion unit can be single double, or multiple. Single sources of propulsion can be oriented to push by placement of a propeller at the aft end of a support member and/or floating skis. The propulsion unit may incorporate hinging or pivots for directional control or may be controlled in the manner used for impeller thrust units on jet skis. Multiple propulsion units can be used for reasons of efficiency or economics. Single support units also can have multiple propulsion units, as for example, placing a propeller at the fore position and placing a propeller at the aft position of the same support member.

According to this general scheme, a (preferably) heavy power supply advantageously is placed primarily under the water surface within one or two enclosed hull(s). Such hull(s), termed herein as "support member(s)" stabilize the craft due to their weight and placement, and preferably provide buoyant lift to the passenger compartment or "platform." This free lift helps account for some of the improved efficiency of embodiments of the invention, which allows electric boats of the design to hydroplane without wasting most of the motor output to lift the boat (and heavy power supply) out of the water. That is, the invention leaves the massive power supply submerged and provides buoyant lift, thus dispensing with the need for a higher output motor. This arrangement, termed "kakusu maruta," which means "hidden log" in Japanese provides new opportunities for boat configurations and gives unexpected advantages. Some favored new configurations and features are summarized in items A through H below.

SPECIFIC EMBODIMENTS

Figure 11:
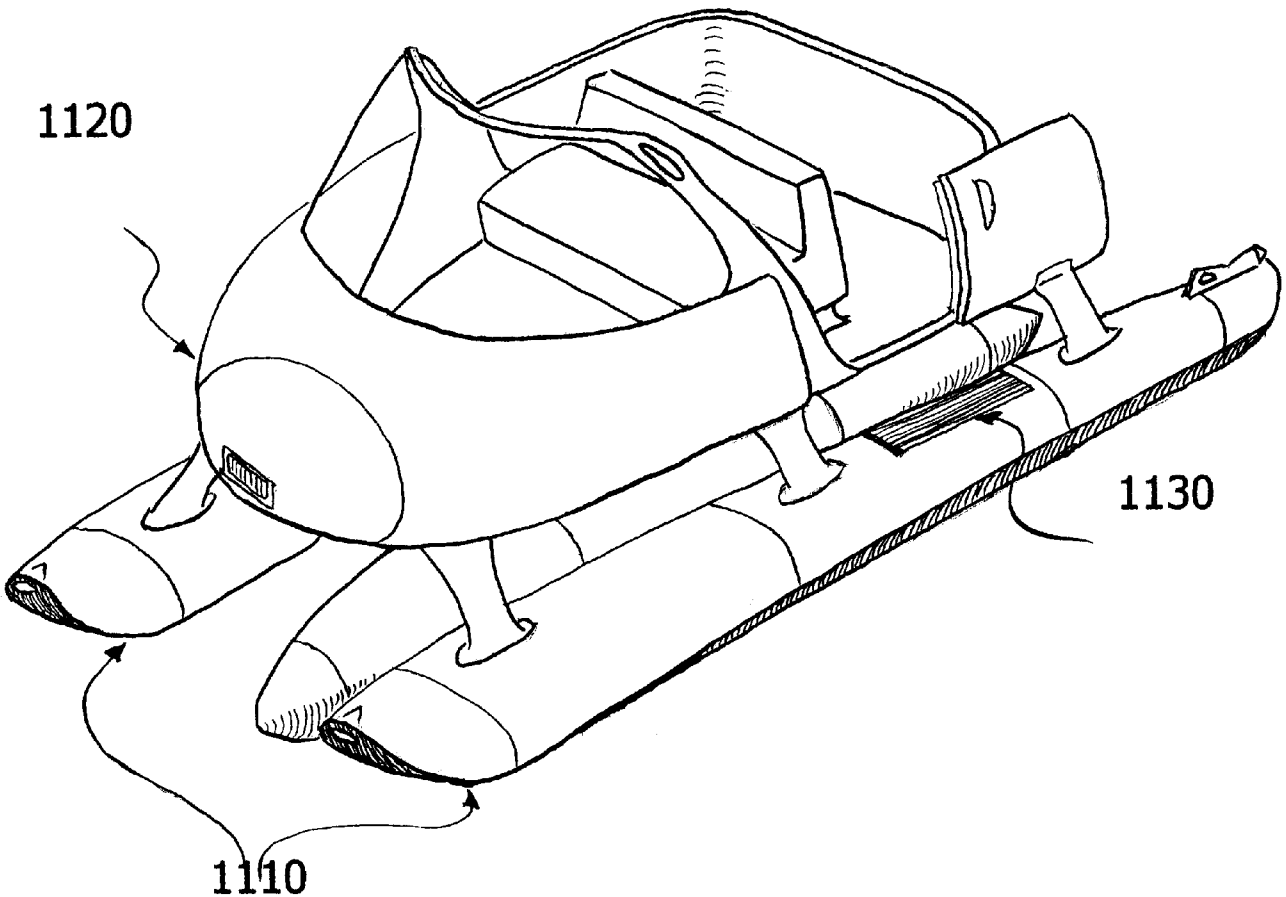
FIG. 11 shows a two place watercraft having two lateral floating skis, one central submerged support member and a platform with a rounded nose and two sliding doors.
Figure 12:
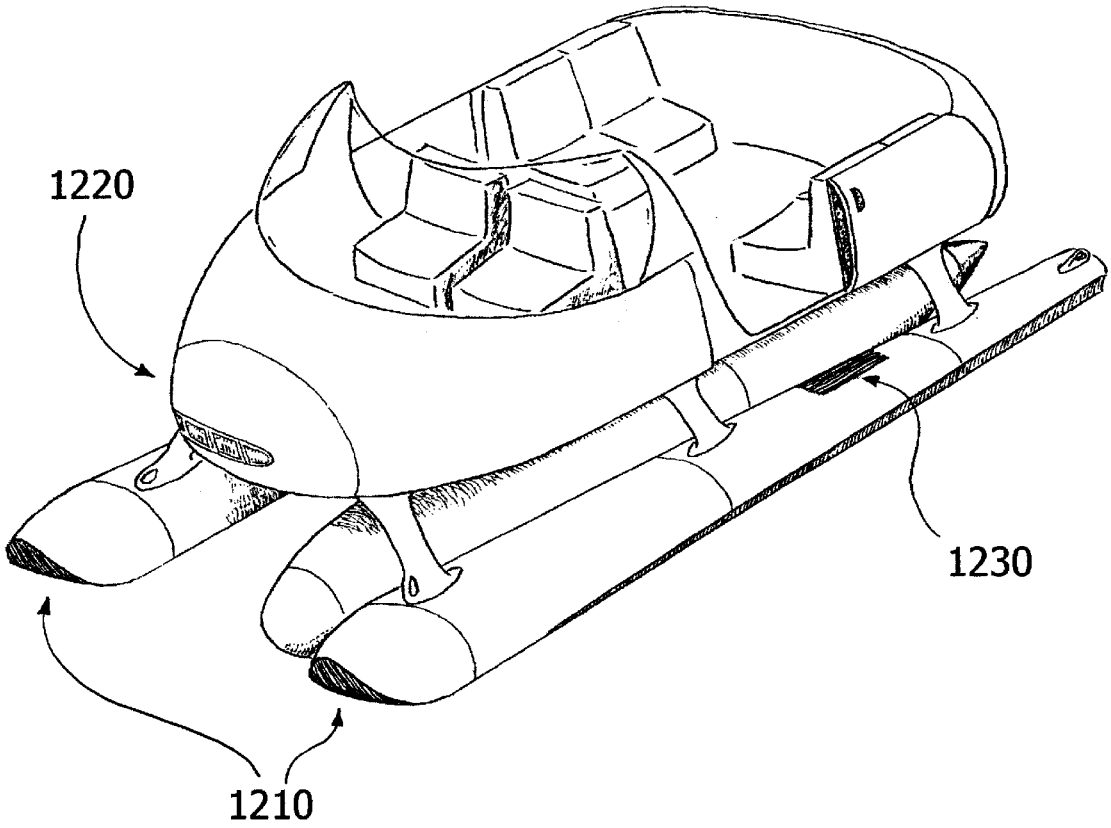
FIG. 12 shows a six place watercraft having two lateral floating skis, one central submerged support member and a platform with a rounded nose and two sliding doors.

A. Dual Waterskis and Rounded Nose Platform with Side Door A preferred embodiment of the invention utilizes dual waterskis attached to a platform through a distance D wherein the platform has a rounded leading edge for minimizing wind resistance and one or more doors to allow easy entrance and exit of the watercraft. This embodiment preferably includes a single support member that contains a power supply and an electric motor, held under but parallel to and between the waterskis wherein the support member is connected to the platform to provide buoyancy to the platform. Preferred combinations of these elements are shown in FIGS. 11 and 12. Having a ski on either side of the watercraft provides enhanced lateral stability. In an advantageous embodiment the lateral skis extend away (sideways) from the platform so as not to reside completely under the platform.

FIGS. 5 through 7 exemplify sporty embodiments where easier and more rapid exit and entry are desired. In the regular and in the sporty embodiments, the egress openings or door(s) may be merely openings in the sides. In embodiments where solid door(s) are used the doors may be mounted in a variety of positions, such as slideably as shown in FIGS. 11 and 12 or on hinges (not shown). Such embodiments of the invention allow easy roll on and roll off access, and are particularly suited for wheel chair access. Most preferably the walls of the watercraft are broken by one such egress opening on each side. In this case, the walls (barriers to horizontal movement above the platform surface) can be seen to comprise a forward wall portion, which is the front section of the cabin (if any) and walls that are fore of the door (egress) openings. The rear wall portion comprises the wall sections (and cabin if present) that are located to the rear of the egress openings. Most preferably the forward edge of an egress opening is further away from the watercraft center than the rear edge of the egress opening. This arrangement helps prevent water spray from entering the rear section of the boat because the width of the rear wall portion is smaller than the width of the front wall portion (i.e. the rear section of the craft is narrower than the front section, which scatters the spray sideways away from the rear section).

B. Side Entry Decks Between Floating Skis and Platform

Another embodiment for higher speed operation employs at least two lateral waterskis, at least one support member, and, in addition, side entry decks (or "egress" platforms), that preferably are continuous between the lateral waterskis and a platform in a manner shown in FIG. 2, FIG. 8 and FIG. 9. The side entry decks preferably extend at least as wide (running lengthwise from front to back of the watercraft) as the entry area. In the example of FIG. 8 the side entry decks extend further frontwards and rearwards than this minimum amount. In the embodiment shown in FIG. 2 the side entry decks extend roughly (within +/−25%) along the usable length (area of passenger movement) of the platform. The slightly wider side entry decks of FIG. 8 are preferred due to the increased strength provided by their coupling of the skis to the platform.

It is particularly desirable to include indentations, steps, cutouts, non-skid surfaces and the like as shown in the proximal side entry decks of FIGS. 2, 8 and 9 to facilitate climbing or walking into and out of the platform. Of course, such features may comprise two or more aids, as exemplified in FIGS. 2 and 9, which show four steps and three steps respectively, terminated with a continuous non-skid surface near the top where the deck surface is more nearly horizontal. Although not shown here, side entry decks also may be used with a platform having doors. For example, floating skis 1110 and 1210 respectively, shown in FIGS. 11 and 12 may be placed further away from platform 1120 and 1220 respectively, for greater stability, and connected by side entry decks on one or both sides of the platform. In any event, it is advantageous to include at least one non-skid surface (1130, 1230 respectively) for the convenience of swimmers.

It will be appreciated that in some instances side entry decks that extend along the entire watercraft may be desired, such as by skin divers who desire a larger diving platform. However, for regular operation, it is preferred to limit the deck width so that at least some wave activity may pass through the watercraft and thus limit the tendency of that wave energy to rock the watercraft, as described in U.S. No. 6,116,182.

C. Central Float pod

In one embodiment, the invention comprises two lateral support members and one central floating surface as shown in FIG. 2. Most preferably in this embodiment, the watercraft rests on the central floating surface 210 respectively, when at rest. During forward motion operation the craft gradually lifts itself off of the central floating surface by virtue of buoyancy (or lifting surfaces) in lateral support members 220 (which may be adjusted by passing water and/or air into each support member). Optionally, further skis may be provided and used in combination to provide lift during forward motion as shown in FIG. 3. Skis 310 in FIG. 3 hydroplane and provide some lift and stability during motion.

Each lateral support member 220 in FIG. 2 preferably provides at least 15% and more preferably at least 30% and yet more preferably at least 40% of the total buoyancy force (force that counteracts the weight of the platform, including occupants) to hold up platform 210 during forward motion. In FIG. 3, additional planing surfaces 310 over each support member 320 provide lateral stability during forward motion.

Lateral skis 310 shown in FIG. 3 preferably provide no significant buoyancy or less than 5% of the total buoyancy. However, in other embodiments not shown here, each ski provides at least 5%, more preferably at least 8%, and yet more preferably at least 15% of the total buoyancy force to stabilize central floating skis/platform surface 315 during rest. During forward motion the lateral skis hydroplane and help support members lift up platform 315. Support members 320 preferably provide at least 20%, and more preferably at least 40% of the total buoyancy.

D. Extended Skis for Increased Speed and Stability

The skis used for the present invention can assume various dimensions and sizes depending on the intended use and expected water conditions. For enhanced stability the floating skis extend forward and aft of the platform surface that is accessible to passengers by at least distance D. In another embodiment the skis extend forward and aft of the load carrying platform by at least 2D. The term "platform surface that is accessible to passengers" means that portion of the platform (which may include the entire platform surface if open to passengers and luggage) where a shift in weight may occur during boat movement. The inventors discovered that best stability and least resistance to movement is obtained by lengthening the skis in front of and behind the platform surface that is accessible to passengers by at least D.

In a preferred embodiment the skis are reversibly connected to the platform by the user, and swapped out depending on the intended use of the watercraft. For example, when the watercraft is to be driven with a small load into heavy waves, a more slender wave piercing skis such as that designed by kayak builders (eg. as little as 15 degree angle starting at the front tip and gradually widening over more than 10% of the ski length) may be used having a much longer length that extends by at least 2D in front of and to the rear of the supported platform weight. A utility ski, on the other hand, would have a more blunt front end and be wider. Those skilled in the art of kayak design are familiar with other shapes and dimensions suitable for a given water type. Generally speaking, choppy waters will require a narrower and longer ski with a sharper leading edge to penetrate waves and preferably the watercraft operator has two or more ski types to choose from and assembles the watercraft prior to use.

E. Rearward Placement of Skis for Improved Speed and Safety

In a particularly desirable embodiment of the invention two lateral floating skis are combined with a central support member and a platform wherein the lateral skis are positioned rearward to locate their centers to the rear of the center of the support member. In one embodiment the center of each skis (center of the length) is least 10% to the rear of the center (center of the length) of the support member and in another embodiment the skis' centers are 20% to 50% to the rear (i.e. centers positioned between 70% to 100% of the length from front to rear) of the support member. Analogous rearward placement of skis can be made for other craft conformations described herein.

The advantageous rearward placement of skis allows higher speed operation because the surface wave produced by the skis tends to cancel the small surface wave produced by the torpedo. A similar effect has been described in U.S. Pat. No. 5,178,085, which is hereby incorporated in its entirety by reference. Another advantage of this ski placement is that a propeller at the rear of the central support member is more protected from accidental collision by an object or person in the water. The rearward extension of the skis allows protection on either side and above the propeller, thereby at least partially blocking the path of a object that may move towards the propeller.

F. Retractable Support member

Figure 13:
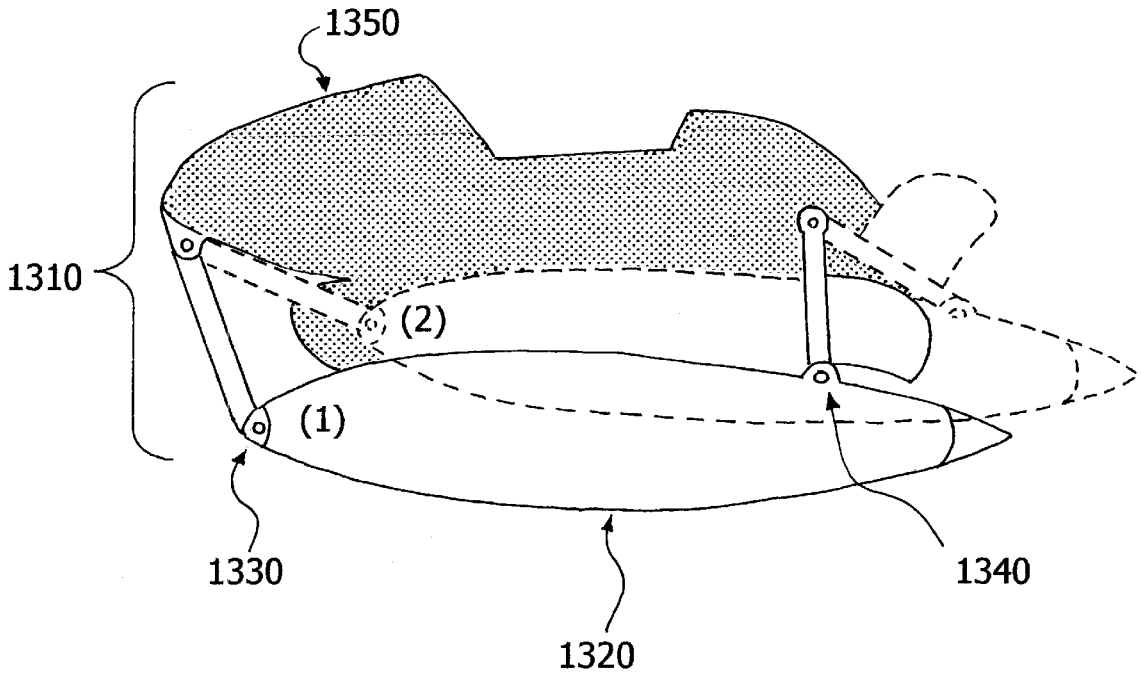
FIG. 13 shows a movable central positioned support unit with a pivot mechanism according to an embodiment of the invention.

In another embodiment of the invention a central support member as exemplified in FIGS. 1, 4–10, 11 and 12 is retractable for easier tailoring and/or depth adjustment during use. FIG. 13 depicts a single support member watercraft 1310 according to the invention (floating ski(s) are not shown). Support member 1320 contains mechanical linkage pivots 1330 and 1340 that provide reversible locking movement of support member 1310 with respect to platform 1350 (shown by dotted line). When watercraft 1310 is to be loaded onto a trailer, support member 1320 is moved from position 1 (shown in solid lines) to position 2 (shown in dotted lines). Alternatively, when watercraft 1310 encounters shallow water, the operator can decrease the watercraft draft by manipulating the support member from position 1 to position 2. The support member can be retracted by moving it back from position 2 to position 1 as needed. Of course, other mechanical connection configurations are possible that decrease the distance between support member 1320 and platform 1350.

G. Resistance to Rough Waters at High Speed

Embodiments of the invention have improved resistance to wave activity. That is, compared with other watercraft of the same size, a watercraft according to embodiments can drive into oncoming waves and experience less shock and vibration. Some embodiments are made possible by a combination of two features. One, a significant proportion of the watercraft mass is in the support member(s) below the water surface. By "significant proportion" is meant at least 10%, preferably 25%, more preferably at least 35% and even more preferably at least 65% of the total empty mass. Two, the floating ski(s) optionally may be connected to the platform by a shock absorber such as a torsion bar or other tensioning device such as that commonly used to provide torsioning for exercise equipment and motorcycle shock absorbers.

The feature of combining (a) the shock absorber connection between floats and platform with (b) having mass in the support member is particularly helpful in dampening, and is advantageous compared with earlier systems such as that shown by U.S. Pat. No. 5,329,870, U.S. Pat. No. 5,174,233 and U.S. Pat. No. 3,517,632. Also helpful is having a support member that is completely submerged, as this helps anchor the platform to give a more stable platform against which the shocks may act, unlike many systems shown by others. Accordingly, watercraft are contemplated that are more stable via combination of a minimum portion of their mass below the water, preferably in a submerged enclosed hull, with shocks that connect a floating portion such as a pontoon (but preferably floating skis) to the platform that is being dampened from vibration.

The combination of a high mass mostly submerged or submerged support member that supports a platform, with one or more floating skis that proportionately support less platform weight, allows the support member to hold the platform more steady when a wave hits the ski(s) and pushes the ski(s) back momentarily. A shock absorber attached between the skis and the platform will "give" and allow the skis to be pushed back and spring forth again with respect to a more steady platform. As a result, a passenger resting on the platform will experience less vibration as the watercraft punches through the waves.

In a most preferred embodiment a watercraft having a smooth ride comprises a single submerged support member and two lateral floating skis connected via a platform such as for example shown in FIGS. 4, 11 and 12 wherein each skis is connected to the platform by one or more shock absorbers. This embodiment works best when a minimum amount of mass (proportionate to the total loaded boat mass) is beneath the water in the central submerged support member because having mass below the water stabilizes the platform when waves hit the floating skis. Preferably at least 25% of the total loaded watercraft weight is in the submerged support member. More preferably at least 35% of the mass is in the support member and even more preferably at least 40% is in the support member. In extreme cases more than 50% of the mass is in the support member.

In another desirable embodiment that is applicable to a wide range of boat designs, the shock is mounted in the skis (or pontoon) itself (preferably in the front) and operates as a shock absorber that absorbs wave energy that hits the front of the skis. Most preferable in this context is a front portion of pontoon (or skis) of less than 10 percent, preferably less than 5% of the skis/pontoon length that moves to the rear upon collision with a wave. Still more preferable in this regard is a frontal shield that protrudes out the front of the skis/pontoon and is held by a retractable plunger. When a wave hits the shield, the plunger gets pushed in (and may generate electricity by connection to a generator) against a force such as a spring loaded shock absorber or magnetic coupling. This results in dampening of the wave energy, and allows the watercraft to proceed with less shock and vibration to the occupants.

A skilled artisan readily will appreciate how to construct a suitable floating skis shock absorber from known materials according to this description. Particularly preferred is a rod or square fiberglass stock from Glasforms, Inc. 271 Barnard Ave. San Jose, Calif. 95125, connected between the platform bottom and each ski(s) strut so that the complete ski(s) is free to momentarily move backwards upon head-on collision with a wave.

In another embodiment, the movement of the skis is coupled to generation of electric energy. Preferably, in this embodiment, a permanent magnet (or less preferably an electromagnet) is attached to the floating skis (or fixed portion of a strut attached to the skis) and slides along or inside another magnet during movement/operation of the shock absorber. The magnetic fields are opposed and provide resistance to motion. In a preferred embodiment two permanent magnets or one permanent and one electromagnet with opposing fields slideably come together during compression of the shock, and provide resistance by virtue of their opposing magnetic fields (north oriented against north, or south oriented against south). When moving against the resistance an electric current is generated in an electromagnet. This current may be used to charge a battery, after undergoing modification (principally by changing to a suitable charging voltage). In this way the shock absorber may be used to regenerate energy by recycling part of the watercraft energy that is lost upon crashing into waves.

A second use of this embodiment is to adjust the resistance of the shock absorber by convenient electronic control of electrical current in one or more electromagnets. To increase the stiffness of a shock absorber, an opposing magnetic field is strengthened by increasing current to the electromagnet accordingly. In an embodiment expected to become important in the future, powerful rare earth magnets or other powerful fixed magnets are used for shock absorbers and the stiffness is adjusted by superimposing magnetic field strength (adding to or subtracting from the fixed field) by an electromagnet to achieve more precise control of stiffness. This embodiment of the invention is useful for other watercraft designs as well which do not employ the kakusu maruta design.

In yet another advantageous embodiment the distance between the platform and a skis (or the tilting of the skis with respect to the platform) is adjusted by a control circuit to compensate for wave activity or for compensating for swells. By way of example, if the crest of a large swell hits the right front skis the watercraft can compensate (minimize rising of the right front corner) by actively controlling the shock (strut length) at the right front corner by shortening the effective distance. Similarly the distance of the platform above the water can be modified to tilt the platform in any direction as needed to help maintain a level platform. Most preferably this control is carried out by adjusting one or more struts at each of four comers of the platform as needed after detection of the swell by a swell monitor. A swell monitor may detect swell activity by any of a number of ways known to skilled artisans. In one embodiment water heights is detected by galvinometric means and in another embodiment detection is via optical means whereby an approaching swell is detected optically from a distance. This embodiment is particularly desirable for larger watercraft (at least 25 feet long) intended for ocean or near ocean conditions where large swells are expected. This embodiment of the invention is useful for other watercraft designs as well that do not use the kakusu maruta design.

H. All Electronic Steering

In a preferred embodiment of the invention, each of two lateral floating skis, combined with a single central support member contains an electric motor. This arrangement provides impulse power and steering from the skis motors. The skis motors drive propellers in the floating skis. According to this embodiment steering and low impulse speed operation are carried out by controlling the relative power applied to the two skis. A watercraft as depicted in any of FIGS. 1, 3–8, and 10–12 and as shown in Example 2 may be outfitted with ski motors in this manner. One problem alleviated by this arrangement is matching propeller efficiency for high speed operation. Low speed operation arises from the impulse power propellers that accelerate the watercraft to a higher speed that is more suitable for the propeller of the support member drive.

In a particularly advantageous embodiment each ski motor has less than one fifth the power of the support member motor and has a propeller that is designed to accelerate the watercraft from rest to near planing speed. The central support member motor has a propeller that is designed for best efficiency above minimum planing speed. During operation the user applies differential power to the ski motors to steer and to accelerate the watercraft to a higher speed where the larger motor/propeller combination is more efficient. This arrangement alleviates the tradeoff of having to use a propeller on a single large motor for efficient thrust at low speeds while having to obtain efficient thrust at faster planing speeds.

Most pleasure watercraft use only one motor or equal motors coupled to one type of fixed propeller. Such fixed blade type propellers have a preferred speed of operation to provide a suitable thrust efficiency. An all electronic watercraft according to this embodiment of the invention optimally combines smaller skis motors with fixed propellers of curvature designed for low watercraft speed operation and also a high power motor with a fixed propeller of more steep curvature designed for best efficiency at high watercraft speed. At low speed the smaller propellers dominate and at high speed the support member propeller dominates.

The motors driving the smaller propellers should be capable of high rotation rate such that the smaller motor/propellers will continue to provide thrust at the higher planing speeds. That is, the skis motors have a wide range of operation to allow operation at high watercraft speed, when most thrust comes from the support member propeller, while allowing thrust at low rpm for low speed maneuvering. For example, 0 to 1000 rpm may be suitable for accelerating a watercraft from 0 to 5 mph whereas 1000 to 5000 rpm allows the skis motors to continue to add (albeit proportionally smaller) thrust for steering at speeds of 25 mph.

Another advantage from combining small impulse skis motors for steering with a central large motor on the support member is that the ability of the skis motors to steer the craft is muted at the higher speeds, where most of the force on the watercraft comes from the central power unit. A problem in the art regarding the use of two widely separated motors for steering has been the difficulty to balance power to the two motors to maintain a straight line of travel. This embodiment of the invention overcomes this limitation by providing strong steering control at low speed but less abrupt steering control at high speeds because most of the thrust at those higher speeds comes from the central thrust unit. In a preferred embodiment the two impulse power motors are controlled by an x-y axis joystick, wherein the joystick has a central button for engaging the central support member thrust unit.

Automated Steering with Easy-to-Manufacture Auto-pilot

Another all electronic steering embodiment is an auto-pilot made from multiple geomagnetic field detectors that are arranged to sense when the watercraft's heading is (a) dead on, (b) slightly off center in either direction, and optionally (c) progressively more off center from a desired set heading. During use, the operator sets a heading, then the device senses whether the watercraft heading is in the selected direction, (requiring no steering control), is heading too much to the left, or is heading too much to the right, requiring course correction by momentarily or permanently altering the steering right or left respectively. The device outputs an electrical signal denoting correct heading, (or no signal meaning no correction needed), or other off center condition. In a second embodiment the device senses at least two levels of off course direction for either side of the desired direction. The two or more levels indicate relative error such that a first lower level of error signal is used to make a low level (weaker) steering adjustment. A second higher level of error signal triggers a high level of steering shift and so of for any successively higher error signals if desired.

Although an electronic steering device according to this embodiment may employ the output of multiple discrete sensors, equivalents of this embodiment may utilize other relative magnetic sensing device(s) that may be analog or digital and may comprise multiple sensing within the same device. The signals indicating error are connected electrically to an electromechanical actuator that controls a rudder or other steering device. For boats that rely on differential thrust for steering, the error signal is fed directly into the controller of the motors as suited to correct the course. This embodiment of the invention is suitable for fossil fuel powered boats and trolling motor powered boats as well as regular electric boats.

Figure 14:
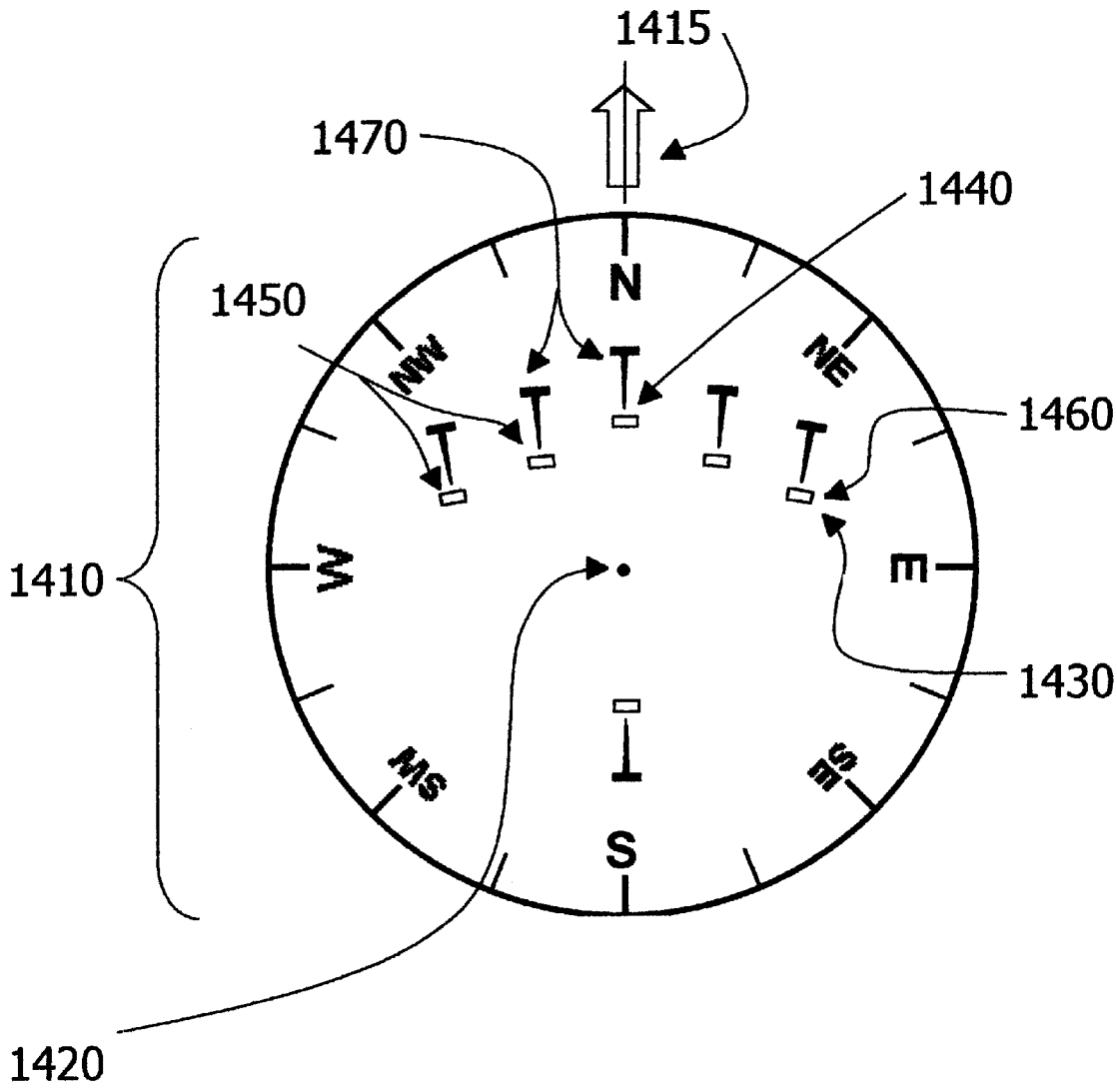
FIG. 14 shows an electronic steering device that comprises a rotatable platen with 6 hall effect sensors mounted within it.

A preferred embodiment of an electronic steering device according to this embodiment of the invention is shown in FIG. 14. Platen 1410 rotates about center 1420 by hand adjustment. The center of the platen may contain a knurled knob or protrusion for easy turning to set the desired direction, which is noted by proximity of dial 1410 markings to fixed "course heading" indicator 1415 which is a fixed mark outside the platen. In an inexpensive embodiment that uses five discrete hall effect sensors and signal amplifying circuitry in the rotatable platen, wires from the platen exit out the rear and are connected to further circuitry to effect steering changes. In this simple "hard wire" method it is preferred that the platen rotate only plus and minus 180 degrees from a set point in order to prevent over twisting of the wires.

FIG. 14 also shows center origin detector 1440 that is used to define a reference magnetic north. The platen contains two more magnetic north sensors 1450 that are oriented (pointed) progressively more to the left of the center origin detector 1440, and two more sensors 1460 that are oriented progressively more to the right. For the sake of explanation, FIG. 14 shows sensors 1450 and 1460 positioned to the left and right of origin detector 1440 respectively, but in practice, the sensors can be placed anywhere on the platen as long as they are facing slightly left and right of the center origin detector, respectively and are fixed in position with respect to detector 1440. By way of example, the first sensor on the left may be positioned so it faces (points) 15 degrees to the left of center, the second sensor from the left is then positioned to face 7.5 degrees to the left of center and the third sensor is positioned to face center (straight up as shown). The fourth sensor then is positioned to face 7.5 degrees to the right of center and the fifth is positioned to face 15 degrees to the right of center. By "positioned" is meant that the sensor is positioned so that its input is oriented in the desired position, which for a typical hall sensor is perpendicular to the center of the marked flat side.

An optional sensitivity enhancer 1470 may be positioned in front of each magnetic field detector. The enhancer is a paramagnetic elongated device that may take shape of a nail and which focuses magnetic field lines to an axis in front of the magnetic field detector to improve sensitivity. The end of the enhancer away from the hall effect device preferably is larger and the end towards the enhancer is pointed, with the diameter of the constricted end approximating the diameter of the sensor chip to facilitate focusing of magnetic field lines into the sensor. In equivalent embodiments where multiple hall sensors are positioned within the same chip but facing at slightly different angles from a center reference, such sensitivity enhancers may be added to the chip as elongated paramagnetic depositions of iron, nickel chromium and the like extending out from the sensitivity spot for paramagnetic device(s) within the chip. The inventor prefers large discrete hall effect devices and particularly, discrete ratiometric hall effect sensors, however, because they are more easily used with large enhancers such as inexpensive low carbon steel nails with sharp points for greater sensitivity. This figure also shows N, S, E, W (etc.) markings. Those markings indicate the desired heading, but become the true heading when the boat is on proper course, as detected by a signal produced from center detector 1440 and decreased or absent left and right error signals, respectively from sensor groups 1450 and 1460.

Figure 15:
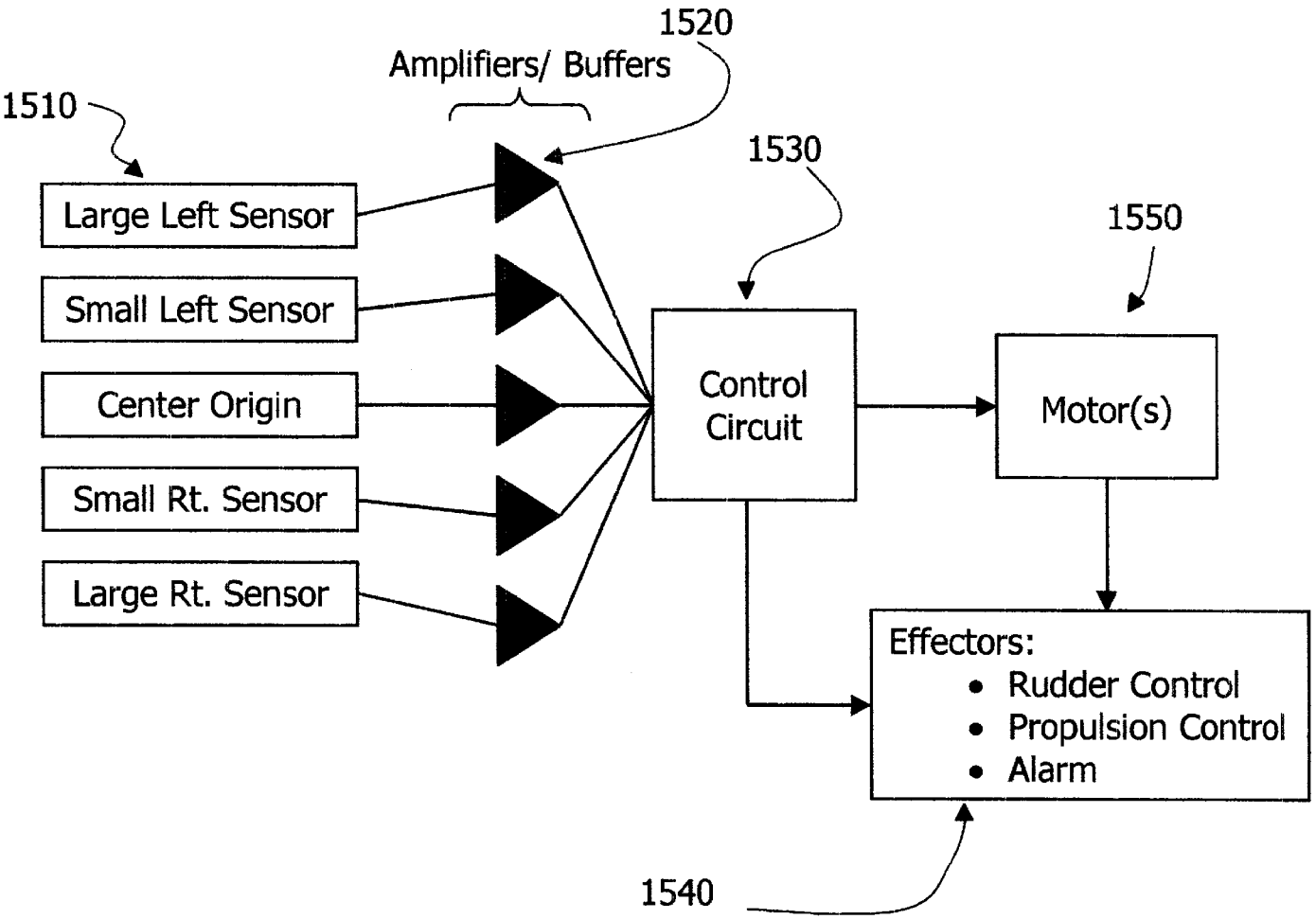
FIG. 15 shows a representative block diagram for using the electronic steering device of FIG. 14.

FIG. 15 shows a representative block diagram outline for implementation of an automated electronic steering device that may be built from easily obtained parts from an electronics parts vendor. The five hall effect sensors 1510 on the left side of this figure are discrete ratiometric hall effect sensors such as type A3515. These are biased to produce signals in response to magnetic fields. Each signal from a hall effect sensor is separately amplified by buffer amplifiers such as MOSFET operational amplifiers 1520 which feed logic chips in control circuit 1530 that produce digital signal output(s) in response to the detection of magnetic north by each hall effect sensor and control motor 1550. In an embodiment not shown here, the amplifier/buffer circuitry, which may be as simple as a transistor amplifier, is built into the hall sensor chip. In another embodiment, two or more sensors are present within the same chip.

A signal may arise to denote any of several conditions. A "course OK" logic signal may come from detection of a sensed magnetic north signal from the center origin detector hall effect sensor. A "slight correction to the right needed" signal may arise from a sensed magnetic north signal detected from the "small left sensor" device that is positioned to face slightly (typically between 2 to 15 degrees, preferably 3 to 8 degrees) to the left of the center origin detector. A "stronger correction to the right needed" signal may arise from a sensed magnetic north signal detected from the "large left sensor" device positioned to face more (typically between 3 to 30 degrees, preferably 5 to 20 degrees) to the left of the center origin detector. Analogous correction signals are determined from the small and large right sensors, and/or other sensors that may be positioned in other orientations. In some embodiments the control signals may not be discrete digital signals but rather analog signals, and are treated in like manner by control circuitry.

In a simplified version of the device, only three hall effect sensors are used, in which case only one kind of correction signal is produced from the control circuit for each side. In another embodiment a large number of sensors are used and their outputs compared either in hardware or by operation of a computer program to decide on how to correct the heading of the watercraft. In yet another embodiment, analog outputs from multiple sensors, either within the same chip, or in different chips, are blended, by summing, comparing, or otherwise as a skilled artisan may readily achieve, before obtaining a control signal to the motor(s).

In one embodiment an additional sensor is used facing substantially away (preferably 180 degrees away) from the center origin detector sensor. A signal produced from the additional sensor indicates that the watercraft has turned around, and needs to be re-oriented. In that case, the control circuit may determine which direction the watercraft has rotated from stored information regarding which error sensor(s) (left or right from center) were activated last. A suitable correction, and or audible alarm to notify the watercraft occupants can be automatically outputted by the control circuit.

The control circuit produces a large electrical pulse or continuous signal to control or directly power at least one motor to effectuate a course change. The motor may be a servo mechanism, solenoid, or other device for adjusting a rudder or steering wheel. The "motor" may consist of two motors that are separated such as floating skis motors and which steer the craft by virtue of their relative power outputs. At least some of the control circuit may be a computer and carried out by software.

In operation, a user turns the platen until a desired heading (0 to 360 degrees of the compass, preferably displayed at the edges of the round platen that contains the sensors) is selected. Preferably the platen compass markings indicate "N" at the center origin sensor detection line, and an adjustment for true magnetic north deviation is built into the platen. Also, course indicator line or other marking 1415 in FIG. 14 should be placed on a surface about which the platen rotates and is used as a set point that lines up with the desired compass markings on the rotating platen.

After setting the platen to a desired heading the device is actuated and steers the watercraft until automatically or manually turned off. For the example shown in FIGS. 14 and 15, there are two modes of operation. In a first mode called "new course setting" the user turns the platen to a desired heading. The control circuit then starts to determine whether any of the hall effect sensors are activated. If a sensor is activated, the control circuit responds by a programmed or set response as exemplified above. For example, if the large right sensor alone is activated, then the control circuit adjusts the watercraft to turn more to the left. More likely, when only 5 or 6 sensors are used, no sensor will be activated upon turning the "new course setting" mode on, in which case the control circuit turns the watercraft in a sharp circle to one side or the other until one of the sensors is activated and a regular response such as described above can be activated. In a second mode setting called "maintain present course" the user turns the platen until the center origin detector is activated, by, for example a light readout and/or audible beep indicator, and the device maintains the course as described. That is, once the watercraft departs from the desired heading one or more hall effect sensors activate and turn on one or more effectors 1540 shown in FIG. 15, which may for example be a rudder, propulsion motor control or alarm.

Another example of the invention is a mechanism and procedure for its use that controls/adjusts the temperature of a storage battery. A battery temperature is adjusted by a peltier heat pump that is thermally attached to the battery, preferably to a terminal of the battery. This embodiment allows faster charging, and in some cases, better discharging through control of battery temperature. During charging the battery temperature is monitored and if the temperature is too high, at least part of the charger current is directed to one or more peltier devices to pump heat out of the battery. The peltier device preferably is connected to a heat sink and most preferably for charging watercraft batteries, is connected to a material that transfers the heat to a body of water that the watercraft is sitting in. This aspect of the embodiment particularly suits lowering temperature of watercraft batteries because a great deal of heat can be easily moved from the battery to a large volume of water. In another embodiment the device is switched as needed to pump in the opposite direction and increase the battery temperature when the battery is too cold. Normally, peltier devices are not efficient and this technique is not that suitable for electric car batteries because a large amount of waste heat is created by the peltier device.

In a preferred embodiment the charger output is maintained at a high or maximum level during charging, even when the battery temperature is too high to absorb a maximum charge rate. A control circuit senses when battery temperature is too high, and automatically shifts part of the charger output to the peltier device(s) to pump heat out of the battery and into a large heat sink, such as a metal tube with water running through it wherein the water comes from a body of water that the watercraft is sitting in. After the battery temperature moves lower, the control circuit increases charging power to the battery. In a preferred embodiment the control is continuous and the power delivered to the battery is gradually decreased with increasing battery temperature while the power delivered to the peltier device(s) gradually increases with increasing battery temperature. This system maximizes use of the charger over prior art wherein the charger output simply is decreased to prevent overheating the battery. This embodiment of the invention takes advantage of a simple and massive heat sink (water) to allow inefficient peltier heat pumping from a battery to the heat sink, while allowing the battery charger to operate at maximum output to both cool the battery and charge at the highest rate possible.

The following examples are meant to illustrate some of the embodiments of the invention and are not meant to limit the scope of the appended claims in any way.

EXAMPLES

1. Waterpony 1

A watercraft having the features shown in FIG. 1 was constructed with dimensions determined by the size and weight of the MPH gang (members Mari-Paula-Hanna). For this example, seven year old M was 50 inches tall, 5 year old P was 44 inches tall and three year old H was 39 inches tall. A single support member of the watercraft was constructed 8 feet long with 10.5 inches maximum diameter tapering to a point in the front and to a 3.5 inch opening in the rear. A 1 horsepower Motorguide brand 3 inch diameter 36 volt motor was glued into the rear of the support member and controlled by a pulse width modulated controller purchased from SLT Technology from Avon, Conn. An unoptimized two blade 9.5 inch diameter propeller was made by gluing, using glass powder in epoxy, two Piranha 9.5×7E propeller blades to a Motorguide propeller hub. Three Sears wheelchair 12 volt glass mat batteries, 22 pounds each were sealed within the support member. Polyurethane floatation (canned spray foam insulation from Loews Hardware) was used to build up an 8 inch layer of floation on top of the skis. The skis were mounted on 90 degree angle galvanized electrical conduit pipes connected to a 32 inch wide by 52 inch long platform. D in this case (distance between the platform bottom and the waterskis bottom) was 15 inches. The front of the platform was a rounded off 14 inch high by 21 inch long fiberglass canopy. The middle of the platform contained a 11.5 inch opening door space on both sides and the rear was a 7 inch tall, (16 inch seat back) 28.5 inch wide seat that was narrower than the front canopy by 3.5 inches in order to minimize carry of spray into a seated passenger.

Un-optiniized, initial experiments with M alone (approximately 50 lbs) indicated a maximum speed of 6.4 miles per hour, as determined with a geopositioning satellite receiver. Experiments with H and P together (70 lbs) indicated 5.5 miles per hour. A major problem arose when one of the MPH test pilots would shift her weight for a more comfortable cruising attitude, making the skis and support member oblique to the water surface and increasing friction. In this case, the floating skis were less than 15 inches (D) longer than the platform in both directions.

In further experiments, 8 foot floating skis of 9 inches and 6 inches width are prepared and swapped out with the 5 foot 3 inch commercial skis for higher speed experiments. Data is obtained showing that the craft with longer skis is more stable to movements of the operators.

2. Waterpony 2

A watercraft is made having one Motorguide motor, batteries, and a single support member with two skis as described in Example 1 above. Two eight foot long 9 inch width straight skis are used, each skis further including a 12 volt 3.125 inch long 8.75 oz Dumas boat motor located 15 inches from the rear of each skis, and connected to a 10 inch 3/16 diameter stainless steel shaft in a stuff box having oiled bearings, driving plastic Dumas propellers (cat no. 3004 and 3008). The propeller shaft exits the bottom of the skis and terminates 1.5 inches below the skis surface and a fin opening is provided to protect the propeller from colliding with a solid object below the skis. Each Dumas motor is controlled by an x-y axis controller that feeds a proportional voltage controller to the motor. A button on the x-y axis controller is connected to a controller to the Motorguide motor within the central skis. During operation, the user engages the two skis motors by pushing or pulling on the joystick as appropriate. The user pushes the joystick button to achieve higher speed operation when the watercraft is pointed in a desired direction.

3. Waterhorse

A watercraft 16 feet long, 8 feet wide having 800 pounds of batteries and an 8 hp motor is constructed as a single support member dual floating skis design described in FIG. 12. The support member is 16 feet long, has a maximum diameter of 24 inches and has a displacement of 1900 pounds. Twelve advanced glass mat lead acid batteries 68 pounds each are mounted in the support member and an eight horsepower 72 volt separately excited Kostov motor from SLT Technology in Avon, Conn. (model KDD7201) is mounted at the stern using direct drive coupling through a watertight hull seal. The platform is 8 feet wide by 10 feet long and positioned 2 feet above the waterline. The watercraft is capable of speeds that exceed 15 miles per hour.

All publications and filed applications referenced herein are specifically incorporated by reference in their entireties.

We claim:

1. An electric motor driven watercraft comprising an upper platform with walls connected beneath to one submerged support member and two floating skis connected by struts wherein the walls have egress openings on their starboard and port sides for easy boarding without stepping over a wall, the support member provides buoyancy yet is completely submerged and positioned lateral to the floating skis and contains an electric motor, and wherein the skis contain floatation that provides buoyancy to maintain watercraft stability during rest and contain at least 2 struts that can be adjusted to control the height of the platform above the water.

2. An electric motor driven watercraft as described in claim 1, wherein the submerged support member is retractable for easy trailoring.

3. An electric motor driven watercraft as described in claim 1, further comprising at least one shock absorber that absorbs wave energy colliding with the floating skis.

4. An electric motor driven watercraft as described in claim 3, wherein the tension of the at least one shock absorber is adjustable electrically.

5. An electric motor driven watercraft as described in claim 1, wherein each strut contains a shock absorber.

6. An electric motor driven watercraft as described in claim 1, comprising side entry decks between each floating skis and the platform.

7. An electric motor driven watercraft as described in claim 1, wherein each floating skis has an electric motor and propeller or impeller at its aft end and provides steering control by energizing the motor.

8. An electric motor driven watercraft as described in claim 1, wherein the support member contains at least 25% of the empty mass of the watercraft.

9. An electric motor driven watercraft comprising an upper platform and a swell monitor with walls connected beneath to one submerged support member and two floating skis connected by struts wherein the walls have egress openings on their starboard and port sides for easy boarding without stepping over a wall, the support member provides buoyancy yet is completely submerged and positioned lateral to the floating skis and contains an electric motor, and wherein the skis contain floatation that provides buoyancy to maintain watercraft stability during rest and contain at least 2 struts that can be adjusted to control the height of the platform above the water, wherein the monitor adjusts at least one strut to compensate for swells by tilting the watercraft in response.

10. An electric motor driven watercraft as described in claim 9, wherein the submerged support member is retractable for easy trailoring.

11. An electric motor driven watercraft as described in claim 9, further comprising at least one shock absorber that absorbs wave energy colliding with the floating skis.

12. An electric motor driven watercraft as described in claim 11, wherein the tension of the at least one shock absorber is adjustable electrically.

13. An electric motor driven watercraft as described in claim 9, wherein each strut contains a shock absorber.

14. An electric motor driven watercraft as described in claim 9, comprising side entry deck between each floating skis and the platform.

15. An electric motor driven watercraft as described in claim 9, wherein each floating skis has an electric motor and propeller or impeller at its aft end and provides steering control by energizing the motor.

16. An electric motor driven watercraft as described in claim 9, wherein the support member contains at least 25% of the empty mass of the watercraft.

17. An electric motor driven watercraft comprising a swell monitor and an upper platform held above the water surface by at least four struts to a distance D and connected beneath to one submerged support member having an electric motor and to two floating skis, wherein the support member is located below, parallel and between the skis and wherein the skis protrude forward of the platform by distance D and protrude rearward of the platform by distance D, wherein the swell monitor outputs a signal that controls the length of the struts to minimize the effect of swells on the watercraft attitude.

18. An electric motor driven watercraft as described in claim 7, further comprising at least one shock absorber that absorbs wave energy colliding with the floating skis.

19. An electric motor driven watercraft as described in claim 7, wherein the support member contains at least 25% of the empty mass of the watercraft.

20. An electric motor driven watercraft comprising an upper platform with walls connected beneath to one or two submerged support members and to one or two floating skis that contain at least two struts and floatation to maintain watercraft stability during rest and that remain at the water surface, wherein the one or two support members provide sufficient buoyancy to lift the platform yet are completely submerged and positioned lateral to and below the floating skis and each contains an electric motor, and wherein the submersion depth of the one or two submerged support members is adjusted by changing the vertical distance between the one or two support members and the one or two floating skis through adjustment of the at least two struts.

* * * * *